United States Patent [19]

Ukai et al.

[11] Patent Number: 4,555,481

[45] Date of Patent: Nov. 26, 1985

[54] SILVER HALIDE PHOTOGRAPHIC EMULSIONS CONTAINING BENZIMIDAZOLOCARBOCYANINE DYE HAVING FLUOROALKYL GROUP AT THE NITROGEN ATOM OF BENZIMIDAZOLE

[75] Inventors: Toshinao Ukai; Masaki Okazaki; Haruo Takei; Ichizo Toya, all of Kanagawa, Japan

[73] Assignee: Fuji Photo Film Co., Ltd., Kanagawa, Japan

[21] Appl. No.: 573,760

[22] Filed: Jan. 25, 1984

[30] Foreign Application Priority Data

Jan. 25, 1983 [JP] Japan ..... 58-10090
Sep. 22, 1983 [JP] Japan ..... 58-175939

[51] Int. Cl.[4] ..... G03C 7/26; G03C 7/32; G03C 1/10

[52] U.S. Cl. ..... 430/550; 430/505; 430/574; 430/576; 430/588; 430/589

[58] Field of Search ..... 430/588, 574, 576, 550, 430/505, 589

[56] References Cited

U.S. PATENT DOCUMENTS

| | | | |
|---|---|---|---|
| 2,739,149 | 3/1956 | Van Lare | 548/325 |
| 2,912,327 | 11/1959 | Maurer | 430/6 |
| 2,912,329 | 11/1959 | Jones et al. | 430/550 |
| 3,769,025 | 10/1973 | Ohkubo et al. | 430/588 X |
| 3,988,513 | 10/1976 | Matsuyama et al. | 430/588 X |
| 4,179,296 | 12/1979 | Sato et al. | 430/588 X |

FOREIGN PATENT DOCUMENTS

| | | |
|---|---|---|
| 654690 | 6/1951 | United Kingdom . |
| 815172 | 6/1959 | United Kingdom . |

OTHER PUBLICATIONS

Troitskaya, V. I. et al., "Cyanine Dyes Containing Fluorine XXVIII. Imidacyanine Dyes with Fluoroalkyl Groups at the Nitrogen Atoms of Benzimidazole", C.A. vol. 79, 54858k, 1973.

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide photographic emulsion is disclosed which contains at least one of benzimidazolocarbocyanine dyes represented by the general formula (I) or (II):

(I)

(II)

wherein a represents an integer of 1 to 8, $R_1$, $R_2$ and which may be identical with or different from one another, represent each $—CH_2(CF_2)_bH$ or a substituted or unsubstituted alkyl group, but at least one of $R_1$, $R_2$ and $R_3$ contains an acid group-containing alkyl group, wherein b, which may be identical with or different from a, represents an integer of 1 to 8, l represents 0 or an integer of 1 to 8, and m represents 0 or an integer of 1 to 8, but $l+m>0$; $R_4$, $R_5$ and $R_6$, which may be identical or different from one another, represent each $—(CH_2)_j(CF_2)_kF$ or a substituted or unsubstituted alkyl group, but at least one of $R_4$, $R_5$ and $R_6$ represents an acid group (for example, sulfo group or carboxyl group, etc.)-containing alkyl group; j represents 0 or an integer of 1 to 8; and k represents 0 or an integer of 1 to 8, but $j+k>0$; $V_1$, $V_2$, $V_3$, $V_4$, $V_5$, $V_6$, $V_7$ and $V_8$, which may be identical with or different from one another, represent each a hydrogen atom, a halogen atom, a substituted alkyl group, an unsubstituted alkyl group, an alkoxy group, an acyl group, an acyloxy group, an alkoxycarbonyl group, a carbamoyl group, a sulfamoyl group, a cyano group or a trifluoromethyl group; X represents an anion; and n represents 1 or 2 but represents 1 when the dye forms an inner salt.

The emulsion has good stability to the passage of time, in which an increase of fog under a high temperature or under a high temperature and a high humidity is controlled and reduction of sensitivity with the passage of time is minimized.

10 Claims, No Drawings

SILVER HALIDE PHOTOGRAPHIC EMULSIONS CONTAINING BENZIMIDAZOLOCARBOCYANINE DYE HAVING FLUOROALKYL GROUP AT THE NITROGEN ATOM OF BENZIMIDAZOLE

FIELD OF THE INVENTION

The present invention relates to spectrally sensitized silver halide photographic emulsions. In greater detail, it relates to silver halide photographic emulsions in which spectral sensitivity of the green wavelength range is particularly increased.

BACKGROUND OF THE INVENTION

In production of light-sensitive materials, it is well known to expand the sensitive wavelength range of silver halide photographic emulsions, namely, to carry out spectral sensitization. Of the spectral sensitization techniques, sensitization of the green wavelength range is important in relation to the fact that eyes of man are very sensitive to light of green wavelength range, because the maximum of luminosity of man is about 545 nm.

It has been well known that addition of a certain kind of benzimidazolocarbocyanine dye is very effective as a means of increasing green sensitivity of silver halide. In this case, the dye added to the silver halide photographic emulsion is adsorbed in silver halide grains in the emulsion to add a longer wavelength absorption zone to the intrinsic absorption zone of silver halide. Namely, spectral sensitization is carried out by the dye.

These techniques have been described in, for example, U.S. Pat. Nos. 2,912,329 and 2,739,149 and British Pat. Nos. 654,690 and 815,172, etc.

However, when benzimidazolocarbocyanine dyes known hitherto are used, an increase of fog is caused under a high temperature or a high temperature and a high humidity after application of the emulsion or stability to the passage of time after application of the emulsion is inferior to cause remarkable reduction of sensitivity. Improvement of these drawbacks of the benzimidazolocarbocyanine dyes, namely, increase of fog under a high temperature or under a high temperature and a high humidity or reduction of sensitivity with passage of time, is one of important subjects in techniques of production of light-sensitive materials.

SUMMARY OF THE INVENTION

An object of the present invention is to provide silver halide photographic emulsions having good stability to the passage of time, in which an increase of fog under a high temperature or under a high temperature and a high humidity is controlled and reduction of sensitivity with the passage of time is minimized.

It has been found that the above-described object of the present invention is attained by preparing silver halide photographic emulsions which contain at least one of benzimidazolocarbocyanine dyes represented by the general formula (I) or (II) in which a fluorine substituted alkyl group is bonded to at least one of nitrogen atoms in the imidazole ring.

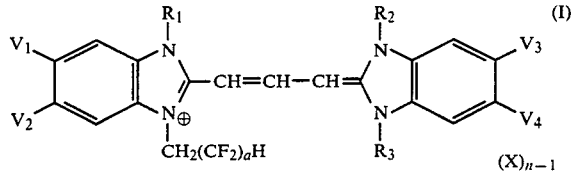

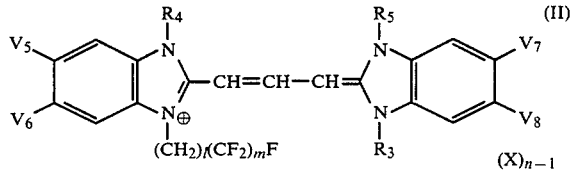

In the formula (I), a represents an integer of 1 to 8. $R_1$, $R_2$ and $R_3$, which may be identical or different one another, represent each $—CH_2(CF_2)_bH$ or a substituted or unsubstituted alkyl group, but at least one of $R_1$, $R_2$ and $R_3$ represents an acid group (for example, a sulfo group or a carboxyl group, etc.)-containing alkyl group. b, which may be identical with or different from a, represents an integer of 1 to 8. $V_1$, $V_2$, $V_3$ and $V_4$, which may be identical or different one another, represent each a hydrogen atom, a halogen atom, a substituted alkyl group, an unsubstituted alkyl group, an alkoxy group, an acyl group, an acyloxy group, an alkoxycarbonyl group, a carbamoyl group, a sulfamoyl group, a cyano group or a trifluoromethyl group. X represents an anion. n represents 1 or 2, but it represents 1 when the dye forms an inner salt.

In the formula (II), l represents 0 or an integer of 1 to 8, and m represents 0 or an integer of 1 to 8, but $l+m>0$. $R_4$, $R_5$ and $R_6$, which may be identical or different one another, represent each $—(CH_2)_j(CF_2)_kF$ or a substituted or unsubstituted alkyl group, but at least one of $R_4$, $R_5$ and $R_6$ represents an acid group (for example, a sulfo group or a carboxyl group, etc.)-containing alkyl group. j represents 0 or an integer of 1 to 8, and k represents 0 or an integer of 1 to 8, but $j+k>0$.

$V_5$, $V_6$, $V_7$, and $V_8$, have the same meanings as $V_1$, $V_2$, $V_3$, and $V_4$, and X and n have the same meanings as defined above for the formula (I).

The general formulae (I) and (II) indicate only ultimate states of the resonance structures, and if they are represented by another ultimate state in which the charge ⊕ is on a nitrogen atom in the other imidazole nucleus, it means the same substance as the above-described substance.

DETAILED DESCRIPTION OF THE INVENTION

In the general formula (I) or (II) of the sensitizing dyes used in the present invention, the following substituents are preferably used as each substituent. Namely, it is preferred that $R_1$, $R_2$ and $R_3$, which may be identical or different one another, represent each $—CH_2(CF_2)_bH$ (wherein b may be identical with or different from a and represents an integer of 1 to 8), an unsubstituted alkyl group having 6 or less carbon atoms (for example, a methyl group, an ethyl group, a propyl group, a butyl group, a pentyl group, a vinylmethyl group or a cyclohexyl group, etc.) or a substituted alkyl group (an alkyl group having 6 or less carbon atoms substituted with substituents for example, a carboxy group, a sulfo group, a cyano group, a halogen atom (for example, a fluorine atom, a chlorine atom or a bromine atom), a hydroxy group, an alkoxycarbonyl group having 8 or less carbon atoms (for example, a methoxycarbonyl group, an ethoxycarbonyl group, a phenoxycarbonyl group or a benzyloxycarbonyl group, etc.), an alkoxy group having 8 or less carbon atoms (for example, a methoxy group, an ethoxy group, a benzyloxy group or a phenetyloxy group, etc.), a monocyclic aryloxy group having 10 or less carbon atoms (for example, a phenoxy group or a p-tolyloxy group, etc.), an acyloxy group having 3 or less carbon atoms (for example, an acetyloxy group or a propionyloxy group, etc.), an acyl group having 8 or less carbon atoms (for example, an acetyl group, a propionyl group, a benzoyl group or a mesyl group, etc.), a carbamoyl group (for example, a carbamoyl group, an N,N-dimethylcarbamoyl group, a morpholinocarbonyl group or a piperidinocarbonyl group, etc.), a sulfamoyl group (for example, a sulfamoyl group, an N,N-dimethylsulfamoyl group, a morpholinosulfonyl group or a piperidinosulfonyl group, etc.), and an aryl group having 10 or less carbon atoms (for example, a phenyl group, a p-hydroxyphenyl group; a p-chlorophenyl group, a p-carboxyphenyl group, a p-sulfophenyl group, a p-methylphenyl group or an α-naphthyl group, etc.), etc.).

It is preferred that $R_4$, $R_5$ and $R_6$, which may be identical or different one another, represent each $-(CH_2)_j(CF_2)_kF$ (wherein j and k, which may be identical or different each other, represent each 0 or an integer of 1 to 8, but $j+k>0$), or the same unsubstituted alkyl group or substituted alkyl group as defined for $R_1$, $R_2$ or $R_3$ in the formula (I).

However, at least one of $R_1$, $R_2$ and $R_3$ and at least one of $R_4$, $R_5$ and $R_6$ should represent a sulfo group- or carboxyl group-containing alkyl group having 6 or less carbon atoms in the alkyl moiety.

It is preferred that $V_1$, $V_2$, $V_3$, $V_4$, $V_5$, $V_6$, $V_7$ and $V_8$ may be identical or different one another, represent each a hydrogen atom, a halogen atom (for example, a fluorine atom, a chlorine atom or a bromine atom, etc.), an alkyl group having 6 or less carbon atoms (for example, a methyl group, an ethyl group, a vinylmethyl group or a cyclohexyl group, etc.), an acyl group having 8 or less carbon atoms (for example, an acetyl group, a propionyl group, a benzoyl group or a mesyl group, etc.), an acyloxy group having 3 or less carbon atoms (for example, an ecetoxy group), an alkoxycarbonyl group having 8 or less carbon atoms (for example, a methoxycarbonyl group, an ethoxycarbonyl group or a benzyloxycarbonyl group, etc.), a carbamoyl group having 8 or less carbon atoms (for example, a carbamoyl group, an N,N-dimethylcarbamoyl group, a morpholinocarbonyl group or a piperidinocarbonyl group, etc.), a sulfamoyl group having 8 or less carbon atoms (for example, a sulfamoyl group, an N,N-dimethylsulfamoyl group, a morpholinosulfonyl group or a piperidinosulfonyl group, etc.), a cyano group, a trifluoromethyl group or a hydroxy group.

In the general formula (I) or (II) of the sensitizing dyes used in the present invention, the following substituents are particularly preferred to use as each substituent. Namely, it is particularly preferred that $R_1$, $R_2$ and $R_3$, which may be identical or different from one another, represent each $-CH_2(CF_2)_bH$ (wherein b, which may be identical with or different from a, represents an integer of 1 to 8), an unsubstituted alkyl group having 6 or less carbon atoms (for example, a methyl group, an ethyl group, a propyl group, a butyl group, a pentyl group, a vinylmethyl group or a cyclohexyl group, etc.) or a substituted alkyl group having 12 or less carbon atoms (an alkyl group having 6 or less carbon atoms which is substituted by substituents, for example, a carboxyl group, a sulfo group, a cyano group, a halogen atom, a hydroxy group, an alkoxycarbonyl group having 6 or less carbon atoms, a monocyclic aryloxy group having 10 or less carbon atoms, an acyloxy group having 3 or less carbon atoms, an acyl group having 8 or less carbon atoms, a sulfamoyl groups or an aryl group having 10 or less carbon atoms, etc.). Further, it is particularly preferred that l and m are $8 \geqq l+m>0$ and that the following substituents are used as each substituent. Namely, it is particularly preferred that $R_4$, $R_5$ and $R_6$, which may be identical or different from one another, represent each $-(CH_2)_j(CF_2)_kF$ (wherein j and k, which may be identical or different from each other, represent each 0 or an integer of 1 to 8, but $j+k>0$, and preferably $8 \geqq j+k>0$), or the same unsubstituted alkyl or substituted alkyl group as defined for $R_1$, $R_2$ or $R_3$ above. However, at least one of $R_1$, $R_2$ and $R_3$ and at least one of $R_4$, $R_5$ and $R_6$ should represent a sulfo group- or carboxyl group-containing alkyl group having 6 or less carbon atoms in the alkyl moiety.

It is particularly preferred that $V_1$, $V_2$, $V_3$, $V_4$, $V_5$, $V_6$, $V_7$ and $V_8$, which may be identical or different from one another, represent each a hydrogen atom, a halogen atom, an alkyl group having 4 or less carbon atoms (for example, a methyl group, an ethyl group or a vinylmethyl group, etc.), an acyl group having 7 or less carbon atoms (for example, an acetyl group, a propionyl group, or a benzoyl group, etc.), an alkoxycarbonyl group having 8 or less carbon atoms, a carbamoyl group having 6 or less carbon atoms (for example, a carbamoyl group, an N,N-dimethylcarbamoyl group or a morpholinocarbonyl group, etc.), a sulfamoyl group having 6 or less carbon atoms (for example, a sulfamoyl group, an N,N-dimethylsulfamoyl group, a morpholinosulfonyl group or a piperidinosulfonyl group, etc.), a cyano group, a trifluoromethyl group or a hydroxy group.

Examples of dyes represented by the general formula (I) or (II) of the present invention are illustrated below. However, the present invention is not restricted to them.

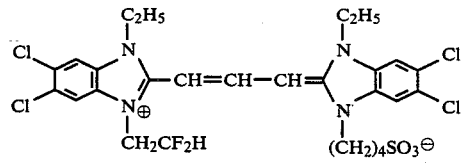

(I-1)

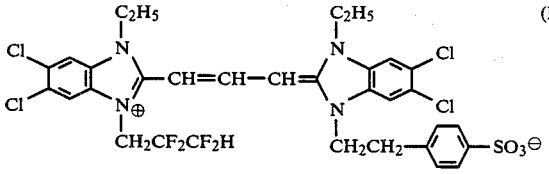

(I-2)

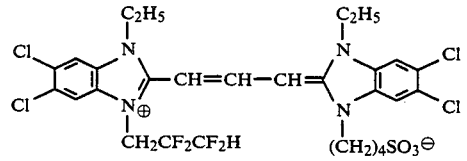

(I-3)

-continued
(I-4)
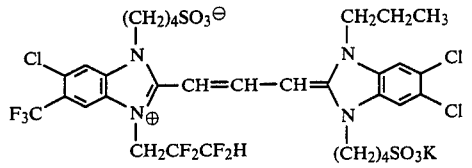
(I-5)
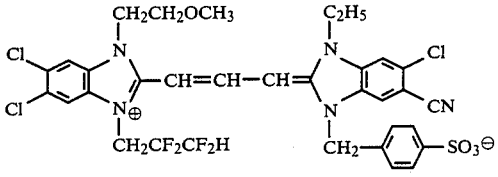
(I-6)
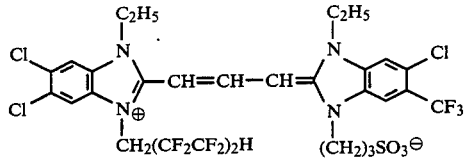
(I-7)
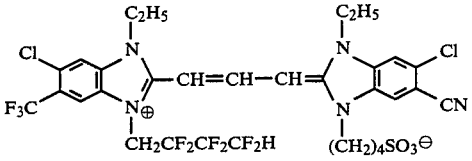
(I-8)
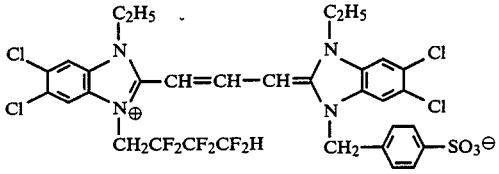
(I-9)
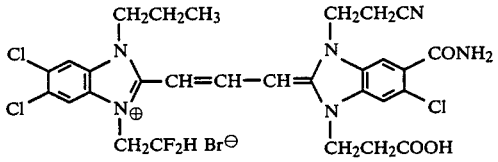
(I-10)
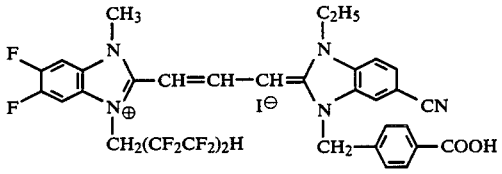
(I-11)
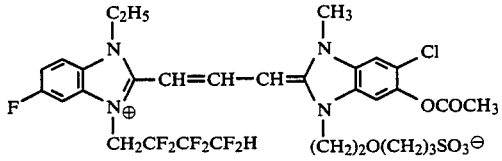
(I-12)
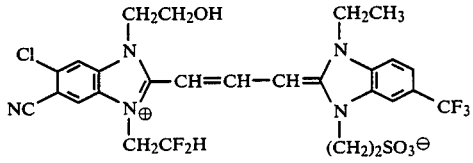
-continued
(I-13)
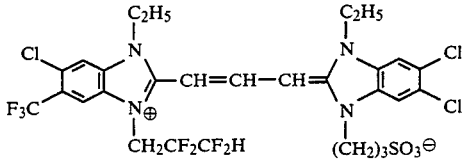
(I-14)
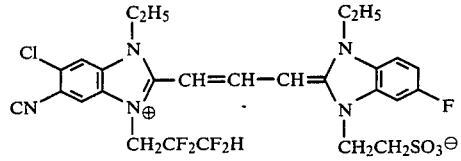
(I-15)
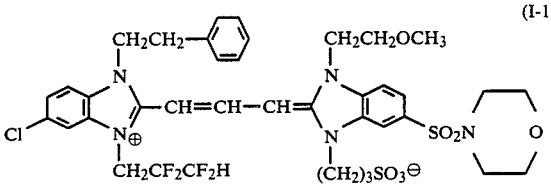
(I-16)
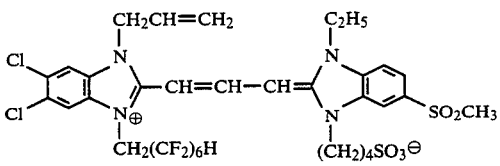
(I-17)
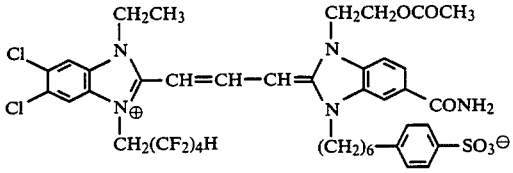
(I-18)
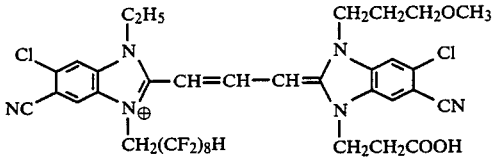
(I-19)
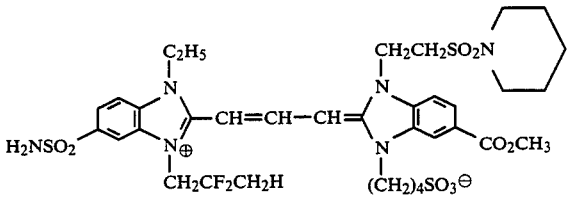
(I-20)
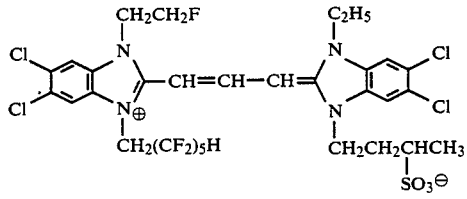

-continued
(I-21)
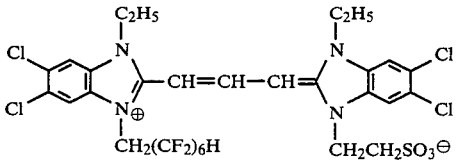
(I-22)
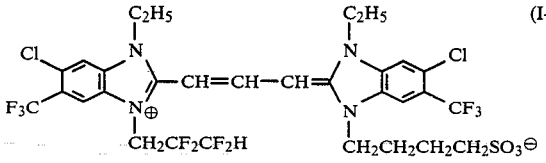
(I-23)
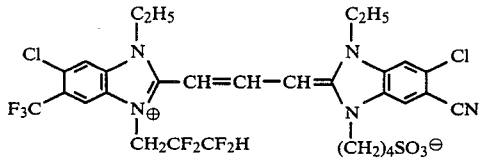
(I-24)
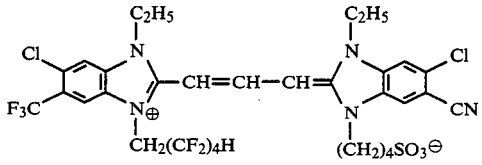
(I-25)
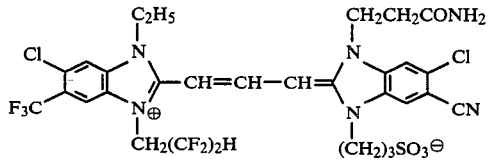
(I-26)
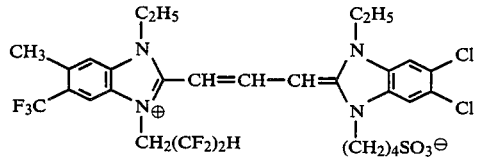
(I-27)
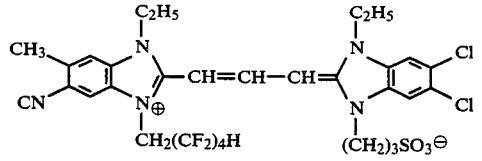
(II-1)
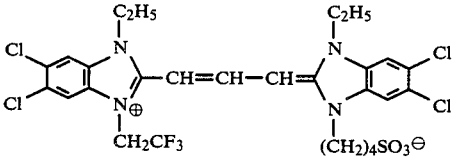
(II-2)
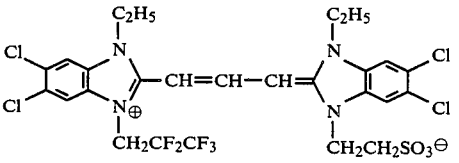
-continued
(II-3)
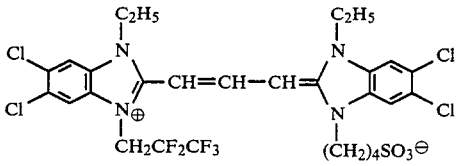
(II-4)
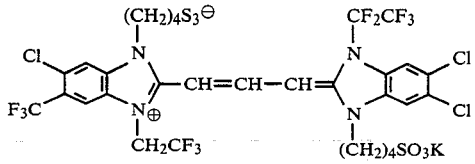
(II-5)
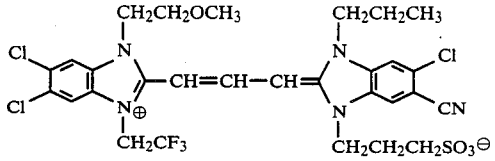
(II-6)
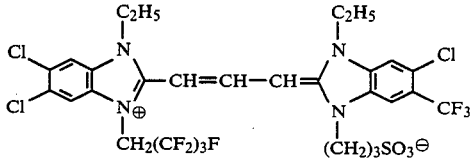
(II-7)
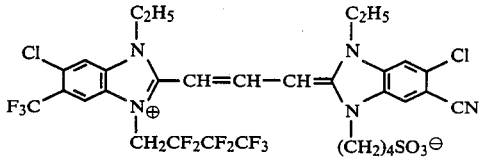
(II-8)
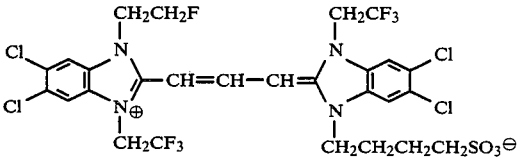
(II-9)
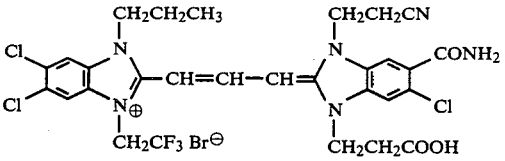
(II-10)
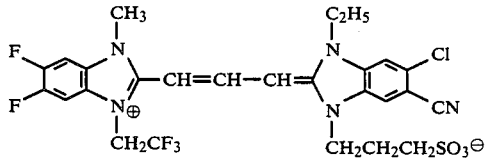
(II-11)
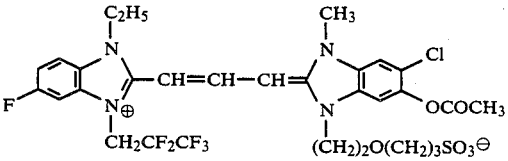

-continued
(II-12)
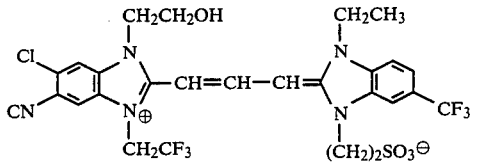
(II-13)
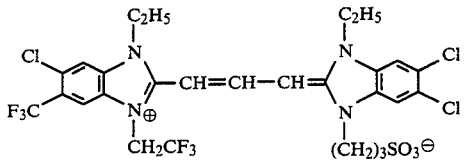
(II-14)
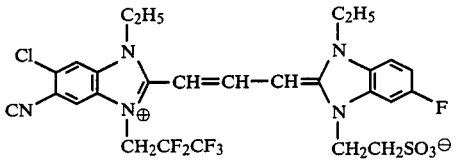
(II-15)
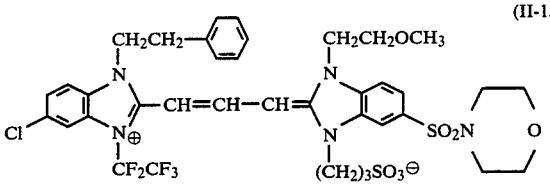
(II-16)
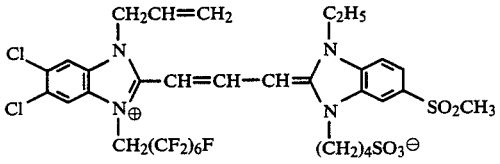
(II-17)
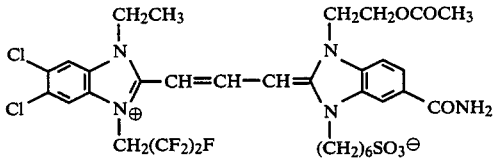
(II-18)
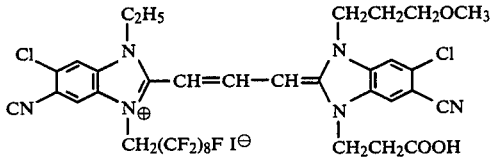
(II-19)
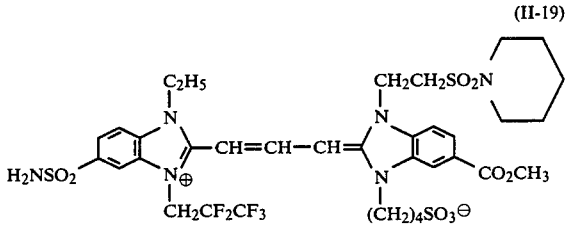
-continued
(II-20)
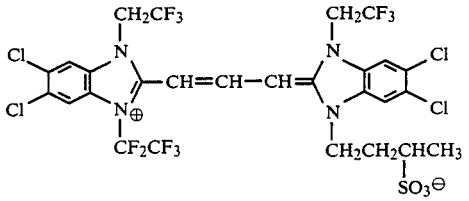
(II-21)
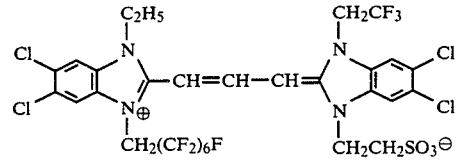
(II-22)
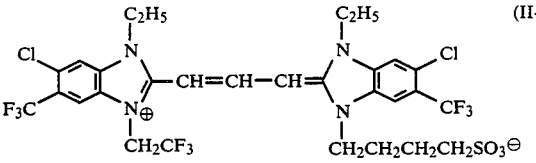
(II-23)
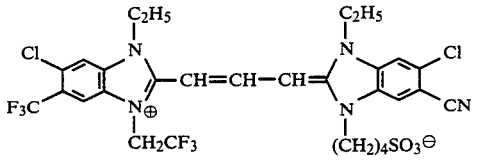
(II-24)
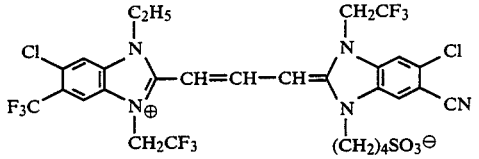
(II-25)
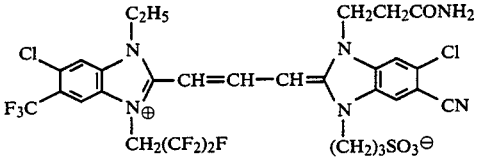
(II-26)
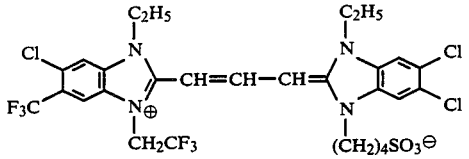
(II-27)
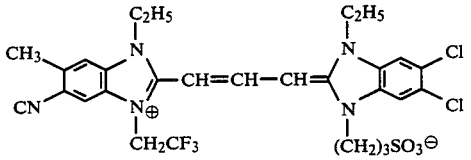
(II-28)
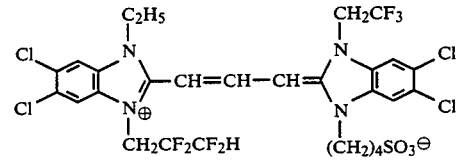
Compounds represented by the general formula (I) or (II) of the present invention can be easily sythesized in the manner described in, for example, U.S. Pat. Nos. 2,912,329 and 2,739,149 and British Pat. Nos. 654,690 and 815,172 using fluorinated alkyl sulfonates, fluorinated alkylamines or fluorinated alkyliodides, etc., sythensized according to the processes described in *J. Org. Chem.*, 26, 4021 (1961); *J. Amer. Chem. Soc.*, 77, 3149 (1955); *J. Amer. Chem. Soc.*, 78, 4999 (1956).

The compounds represented by the general formula (I) and/or (II) are contained in silver halide photographic emulsions in amount of $5\times10^{-7}$ mol to $5\times10^{-3}$ mol, preferably $5\times10^{-6}$ mol to $2\times10^{-3}$ mol and, more preferably $1\times10^{-5}$ mol to $1\times10^{-3}$ mol, per mol of silver halide. Two or more compounds of the formula (I) or of the formula (II) may be used in admixture.

The sensitizing dyes used in the present invention can be directly dispersed in emulsions. Further, they can be added to the emulsion in a state of a solution which is prepared by dissolving them in a suitable solvent such as methyl alcohol, ethyl alcohol, propyl alcohol, methyl cellulose, halogenated alcohols described in Japanese Patent Application (OPI) 9715/73 (the term "OPI" as used herein refers to a "published unexamined Japanese patent application") and U.S. Pat. No. 3,756,830, acetone, water or pyridine, etc., or a mixed solvent of them. As other methods for addition, it is possible to use methods described in Japanese Patent Publication No. 24185/71 and U.S. Pat. Nos. 3,822,135, 3,660,101, 2,912,343, 2,996,287, 3,429,835 and 3,658,546. Moreover, it is possible to use a method described in German Patent Application (OLS) No. 2,104,283 and a method described in U.S. Pat. No. 3,649,286.

Although the above-described sensitizing dyes may be uniformly dispersed in the silver halide emulsion before application to a suitable base, they can be dispersed in any stage of preparation of the silver halide emulsion.

In the photographic emulsions of the present invention, any of silver bromide, silver iodobromide, silver iodochlorobromide, silver chlorobromide and silver chloride may be used. Preferred silver halide is silver bromide, silver chlorobromide, silver iodobromide or silver iodochlorobromide.

Silver halide grains in the photographic emulsions may have a regular crystal form such as cube or octahedron. Further, they may have an irregular crystal form such as sphere or plate, etc., or may have a complex crystal form of them. They may be composed of a mixture of grains having various crystal forms.

The inner part and the surface layer of the silver halide grains may have each a different phase or the silver halide grains may be composed of a uniform phase. Further, they may be grains wherein latent images are formed mainly on the surface (for example, negative type emulsion) or may be grains wherein the latent images are formed mainly in the inner part (for example, internal latent image type emulsions and previously fogged direct reversal emulsions).

The photographic emulsions used in the present invention can be prepared by processes described in *Chimie et Physique Photographique*, written by P. Glafkides (published by Paul Montel Co., 1967), *Photographic Emulsion Chemistry*, written by G. F. Duffin (published by The Focal Press, 1966) and *Making and Coating Photographic Emulsion*, written by V. L. Zelikman et al. (published by The Focal Press, 1964), etc. Namely, any of an acid process, a neutral process and an ammonia process may be used. Further, in order to react soluble silver salts with soluble halogen salts, any of a single jet process, a double jet process and a combination of them, etc., may be used.

A process for forming grains in the presence of excess silver ion (the so-called back-mixing process) can be used, too. As one of the simultaneous mixing processes, it is possible to use a process in which the pAg of the liquid phase for forming silver halide is kept at a constant value, namely, the so-called controlled double-jet process, too.

According to this process, silver halide emulsions having a regular crystal form and a nearly uniform particle size are obtained.

Two or more silver halide emulsions which are prepared respectively may be used as a mixture.

Further, in order to control growth of grains in case of forming silver halide grains, it is possible to use, as solvents for silver halide, for example, ammonia, potassium rhodanate, ammonium rhodanate, thioether compounds (for example, U.S. Pat. Nos. 3,271,157, 3,574,628, 3,704,130, 4,297,439 and 4,276,374, etc.), thione compounds (for example, Japanese Patent Application (OPI) Nos. 144319/78, 82408/78 and 77737/80, etc.) and amine compounds (for example, Japanese Patent Application (OPI) No. 100717/79, etc.), etc.

Formation of silver halide grains or physical aging may be carried out in the presence of cadmium salts, zinc salts, thallium salts, iridium salts or complex salts thereof, rhodium salts or complex salts thereof, or iron salts or complex salts thereof, etc.

Further, as internal latent image type emulsions used in the present invention, there are, for example, conversion type emulsions, core/shell type emulsions and emulsions containing hetero metals, etc., described in U.S. Pat. Nos. 2,592,250, 3,206,313, 3,447,927, 3,761,276 and 3,935,014, etc.

In order to remove soluble salts from emulsions after formation by precipitation or after physical aging, a noodle water wash process wherein gelatin is gelled may be used, and a precipitation process (flocculation) utilizing inorganic salts, anionic surface active agents, anionic polymers (for example, polystyrenesulfonic acid) or gelatin derivatives (for example, acylated gelatin or carbamoylated gelatin, etc.) may be used.

The silver halide emulsions are generally chemically sensitized. In order to carry out chemical sensitization, it is possible to use, for example, a process described in *Die Grundlagen der Photographischen Prozesse mit Silberhalogeniden*, edited by H. Frieser (Akademische Verlagsgesellschaft, 1968), pages 675–734.

Namely, it is possible to use a sulfur sensitization process using sulfur containing compounds capable of reacting with active gelatin or silver (for example, thiosulfates, thioureas, mercapto compounds or rhodanines), a reduction sensitization process using reducing substances (for example, stannous salts, amines, hydrazine derivatives, formamidinesulfinic acid, or silane compounds) and a noble metal sensitization process using noble metal compounds (for example, gold complex salts and complex salts of metals of Group VIII in the Periodic Table, such as Pt, Ir or Pd, etc.), etc., which may be used alone or as a combination of them.

Examples of the sulfur sensitization process have been described in U.S. Pat. Nos. 1,574,944, 2,410,689, 2,278,947, 2,728,668 and 3,656,955, etc. Examples of the reduction sensitization process have been described in U.S. Pat. Nos. 2,983,609, 2,419,974 and 4,054,458, etc. Examples of the noble metal sensitization process have been described in U.S. Pat. Nos. 2,399,083 and 2,448,060 and British Pat. No. 618,061, etc.

Examples of chemical sensitizers include sulfur sensitizers such as allyl thiocarbamide, thiourea, sodium thiosulfate or cystine, etc., noble metal sensitizers such as potassium chloroaurate, aurous thiosulfate or potassium chloropalladate, etc., and reduction sensitizers such as stannous chloride, phenylhydrazine or reductone, etc. They may include sensitizers such as polyoxyethylene compounds, polyoxypropylene compounds or compounds having a quaternary ammonium group, etc.

To the photographic emulsions used in the present invention, it is possible to add various compounds for the purpose of preventing fogging in the process of producing light-sensitive materials, during preservation or during photographic processing, or of stabilizing photographic properties. Namely, it is possible to add many compounds known as antifoggants or stabilizers, such as azoles, for example, benzothiazolium salts, nitroimidazoles, triazoles, benzotriazoles and benzimidazoles (particularly, nitro or halogen substituted compounds); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyrimidines; the above-described heterocyclic mercapto compounds which have water-soluble groups such as a carboxyl group or a sulfo group, etc.; thioketo compounds, for example, oxazolinethione; azaindenes, for example, tetraazaindenes (particularly, 4-hydroxy-substituted (1,3,3a,7)tetraazaindenes); benzenethiosulfonic acids; or benzenesulfinic acid, etc.

The silver halide photographic emulsions of the present invention may contain color couplers such as cyan couplers, magenta couplers or yellow couplers, etc., and compounds which disperse the coupler.

Namely, they may contain compounds capable of coloring by oxidative coupling with aromatic primary amine developing agents (for example, phenylenediamine derivatives or aminophenol derivatives, etc.) in the color development processing. Examples of magenta couplers include 5-pyrazolone couplers, pyrazolobenzimidazole couplers, cyanoacetylcoumarone couplers and ring-opened chain acylacetonitrile couplers, etc. Examples of yellow couplers include acylacetamide couplers (for example, benzoylacetanilides and pivaloylacetanilides), etc. Examples of cyan couplers include naphthol couplers and phenol couplers, etc. It is preferred that these couplers are non-diffusible compounds which have a hydrophobic group called a ballast group in the molecule. The couplers may be any of 4-equivalent ones and 2-equivalent ones to silver ions. Further, the couplers may be colored couplers which have an effect of color correction or couplers which release a development inhibitor by development (the so-called DIR couplers).

Further, they may contain non-coloring DIR coupling compounds which form a colorless product by a coupling reaction and release a development inhibitor in addition to the DIR couplers.

Among the color couplers, magenta couplers may be particularly contained. Examples of magenta couplers include those described in U.S. Pat. Nos. 2,600,778, 2,983,608, 3,062,653, 3,127,269, 3,311,476, 3,419,391, 3,519,429, 3,558,319, 3,582,322, 3,615,506, 3,834,908, 3,891,445, and 4,310,623 German Pat. No. 1,810,464, German Patent Application (OLS) Nos. 2,408,665, 2,417,945, 2,418,959 and 2,424,467, Japanese Patent Publication No. 6031/65, Japanese Patent Application (OPI) Nos. 58922/77, 129538/74, 74027/74 159336/75, 42121/77, 74028/74, 60233/75, 26541/76 and 55122/78, etc.

Examples of yellow couplers include those described in U.S. Pat. Nos. 2,875,057, 3,265,506, 3,408,194, 3,551,155, 3,582,322, 3,725,072 and 3,891,445, German Pat. No. 1,547,868, German Patent Application (OLS) Nos. 2,219,917, 2,261,361 and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/75, 82424/77 and 115219/77, etc.

Examples of cyan couplers include those described in U.S. Pat. Nos. 2,369,929, 2,434,272, 2,474,293, 2,521,908, 2,895,926, 3,034,892, 3,311,476, 3,458,315, 3,476,563, 3,583,971, 3,591,383, 3,767,411 and 4,004,929, German Patent Application (OLS) Nos. 2,414,830 and 2,454,329, and Japanese Patent Application (OPI) Nos. 59838/73, 26034/76, 5055/73, 146828/76, 69624/77 and 90932/77.

As colored couplers, it is possible to use those described in, for example, U.S. Pat. No. 3,476,560, Japanese Patent Publication Nos. 2016/69, 22335/63, 11304/67 and 32461/69, Japanese Patent Application (OPI) Nos. 26034/76 and 42121/77, and German Patent Application (OLS) No. 2,418,959.

As DIR couplers, it is possible to use those described in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) Nos. 69624/77 and 122335/74, and Japanese Patent Publication No. 16141/76.

In addition to DIR couplers, the light-sensitive materials may contain compounds which release a development inhibitor by development. For example, it is possible to use those described in U.S. Pat. Nos. 3,297,445 and 3,379,529, German Patent Application (OLS) Nos. 2,417,914, and Japanese Patent Application (OPI) Nos. 15271/77 and 9116/78.

In order to introduce couplers into the silver halide emulsion layers, known methods, for example, a method described in U.S. Pat. No. 2,322,027, can be used. For example, they are dispersed in hydrophilic colloids after dissolved in phthalic acid alkyl esters (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyllaurylamide), aliphatic acid esters (for example, dibutoxyethyl succinate or dioctyl azelate) or trimesic acid esters (for example, tributyl trimesate), etc., or solvents having a boiling point of about 30° C. to 150° C., such as lower alkyl acetate such as ethyl acetate or butyl acetate, ethyl propionate, secondary butyl alcohol, methyl isobutyl ketone, $\beta$-ethoxyethyl acetate or methyl cellosolve acetate. The above-described high boiling point organic solvents and low boiling point organic solvents may be used as a mixture of them.

For the purpose of increasing sensitivity, increasing contrast or accelerating development, the photographic emulsions of the present invention may contain, for example, polyalkylene oxide or derivatives thereof such as ethers, esters or amines, etc., thioether compounds, thiomorpholines, quaternary ammonium salt compounds, urethane derivatives, urea derivatives, imidazole derivatives or 3-pyrazolidones, etc.

The silver halide photographic emulsions of the present invention may contain water-soluble dyes (for example, oxonol dyes, hemioxonol dyes or merocyanine dyes) as filter dyes or for the purpose of preventing irradiation or others.

The photographic emulsions of the present invention may contain surface active agents for various purposes, for example, as coating aids or for prevention of electrification, improvement of lubricating property, emulsification and dispersion, prevention of adhesion and improvement of photographic properties (for example, acceleration of development, hard toning or sensitization), etc.

For example, it is possible to use nonionic surface active agents such as saponin (steroid type), alkylene oxide derivatives (for example, polyethylene glycol and polyethylene glycol alkyl esters), glycidol derivatives, aliphatic acid esters of polyhydric alcohols or alkyl esters of saccharose, etc.; ampholytic surface active agents such as alkylcarboxylic acid salts, alkylsulfonic acid salts, alkylbenzenesulfonic acid salts or alkyl sulfuric acid esters, etc., and cationic surface active agents such as alkylamine salts, aliphatic or aromatic quaternary ammonium salts, or heterocyclic quaternary ammonium salts such as pyridinium salt or imidazolium salt, etc.

In carrying out the present invention, the following known antifading agents can be used. Further, dye image stabilizers used in the present invention can be used alone or as a mixture of two or more of them. As the known antifading agents, there are hydroquinone derivatives, gallic acid derivatives, p-alkoxyphenols, p-oxyphenol derivatives and bisphenols, etc.

In the photographic light-sensitive materials of the present invention, photographic emulsion layers and other hydrophilic colloid layers may contain dispersions of water-insoluble or poorly-soluble synthetic polymers for the purpose of improving dimensional stability, etc. For example, it is possible to use polymers composed of one or more monomer components such as alkyl acrylate (methacrylate), alkoxyalkyl acrylate (methacrylate), glycidyl acrylate (methacrylate), acrylamide (methacrylamide), vinyl ester (for example, vinyl acetate), acrylonitrile, olefin and styrene, etc., and polymers composed of a combination of the above-described monomer components and acrylic acid, methacrylic acid, $\alpha,\beta$-unsaturated dicarboxylic acid, hydroxyalkyl acrylate (methacrylate), sulfoalkyl acrylate (methacrylate) or styrenesulfonic acid, etc.

The photographic emulsions of the present invention may contain inorganic or organic hardening agents. For example, it is possible to use chromium salts (chromium alum and chromium acetate, etc.), aldehydes (formaldehyde, glyoxal and glutaraldehyde, etc.), active vinyl compounds (1,3,5-triacryloylhexahydro-s-triazine and 1,3-vinylsulfonyl-2-propanol, etc.), and active halogen compounds (2,4-dichloro-6-hydroxy-s-triazine, etc.), etc., which may be used alone or as a combination of them.

The light-sensitive materials produced according to the present invention may contain hydroquinone derivatives, aminophenol derivatives, gallic acid derivatives or ascorbic acid derivatives, etc., as anti-color-fogging agents.

The light-sensitive materials produced according to the present invention may contain ultraviolet ray absorbing agents in the hydrophilic colloid layers. For example, it is possible to use aryl group substituted benzotriazole compounds, 4-thiazolidone compounds, benzophenone compounds, cinnamic acid ester compounds, butadiene compounds, benzoxazole compounds and ultraviolet ray absorbing polymers, etc. These ultraviolet ray absorbing agents may be fixed in the hydrophilic colloid layers.

In the light-sensitive materials produced according to the present invention, when dyes or ultraviolet ray absorbing agents, etc., are contained in the hydrophilic colloid layers, they may be mordanted by cationic polymers.

The above-described various additives have been described in detail in *Research Disclosure,* Vol. 176 (1978, XII), RD-17643, etc.

To the silver halide photographic emulsions used in the present invention, it is possible to add, as protective colloids, gelatin or acrylated gelatin such as phthalated gelatin or malonated gelatin, cellulose compounds such as hydroxyethyl cellulose or carboxymethyl cellulose, soluble starch such as dextrin, hydrophilic polymers such as polyvinyl alcohol, polyvinyl pyrrolidone, polyacrylamide or polystyrenesulfonic acid, plasticizers for giving dimensional stability, latex polymers and matting agents. The finished emulsions may be applied to suitable bases, for example, baryta paper, resin coated paper, synthetic paper, triacetate films, polyethylene terephthalate films or other plastic bases or glass plates, etc.

Exposure to light for obtaining photographic images may be carried out by conventional methods. Namely, it is possible to use known various kinds of light sources such as natural light (sunlight), tungsten lamps, fluorescent lamps, mercury lamps, xenon arc lamps, carbon arc lamps, xenon flash lamps or cathode-ray tube flying spots, etc. As an exposure time, it is possible to use not only exposure for 1/1,000 second to 1 second which is conventionally used for cameras, but also exposure for shorter than 1/1,000 second, for example, exposure for $1/10^4$ to $1/10^6$ second by a xenon flash lamp or a cathode ray tube, and exposure for longer than 1 second. If necessary, the spectral composition of light used for exposure can be controlled by color filters. Laser rays can be used for exposure, too. Further, the exposure may be carried out by rays emitted from fluophosphors excited by electron rays, X-rays, $\gamma$-rays or $\alpha$-rays, etc.

Spectral sensitizing dyes in the present invention are used for sensitizing various silver halide photographic emulsions for color and black-and-white sensitive materials. Examples of emulsions used include color positive emulsions, color paper emulsions, color negative emulsions, color reversal emulsions (which may contain couplers or not contain couplers), emulsions for plate making photographic light-sensitive materials (for example, litho film, etc.), emulsions used for light-sensitive materials for cathode-ray tube display, emulsions used for light-sensitive materials for recording X-rays (particularly, direct or indirect roentgenographic materials using a screen), emulsions used for a colloid transfer process (described in, for example, U.S. Pat. No. 2,716,059), emulsions used for a silver salt diffusion transfer process (described in, for example, U.S. Pat. Nos. 2,352,014, 2,543,181, 3,020,155 and 2,861,885, etc.), emulsions used for a color diffusion transfer process (described in U.S. Pat. Nos. 3,087,817, 3,185,567, 2,983,606, 3,253,915, 3,227,550, 3,227,551, 3,227,552, 3,415,644, 3,415,645 and 3,415,646, etc.), emulsions used for a dye transfer process (imbibition transfer process)

(described in U.S. Pat. No. 2,882,156, etc.), emulsions used for a silver-dye bleaching process (described in Friedman, *History of Color Photography* (American Photographic Publishers Co., 1944, particularly, Chapter 24) and *British Journal of Photography,* Vol. 111, pp. 308 and 309, Apr. 7, 1964), emulsions used for materials for recording printing-out images (described in, for example, U.S. Pat. No. 2,369,449 and Belgian Pat. No. 704,976, etc.), emulsions used for light development type printing-out (direct print image) sensitive materials (described in, for example, U.S. Pat. Nos. 3,033,682 and 3,287,137, etc.), emulsions used for heat-developable light-sensitive materials (described in, for example, U.S. Pat. Nos. 3,152,904, 3,312,550 and 3,148,122 and British Pat. No. 1,110,046, etc.), and emulsions used for physical development light-sensitive materials (described in, for example, British Pat. Nos. 920,277 and 1,131,238, etc.), etc.

In order to carry out photographic processing of the light-sensitive materials produced according to the present invention, it is possible to utilize known processes and known processing solutions, as described in, for example, *Research Disclosure,* Vol. 176, pages 28–30. The photographic processing may be either the photographic processing for forming silver images (black-and-white photographic processing) or photographic processing for forming dye images (color photographic processing) as occasion demands. The processing temperature is selected generally from the range of 18° C. to 50° C., but a temperature of lower than 18° C. or a temperature of higher than 50° C. may be used.

The photographic emulsions of the present invention may be used for the following color diffusion transfer process. The emulsions used may be any of negative type emulsions of forming surface latent images or direct reversal type emulsions. As the latter cases, there are internal latent image type emulsions and previously fogged direct reversal type emulsions. Particularly, the internal latent image type silver halide emulsions are advantageously used. Examples of this type of emulsion include conversion type emulsions, core/shell type emulsions and hetero metal containing emulsions, etc., described in U.S. Pat. Nos. 2,592,250, 3,206,313, 3,447,927, 3,761,276 and 3,935,014, etc.

Examples of fogging agents for this type of emulsion include hydrazines described in U.S. Pat. Nos. 2,588,982 and 2,563,785, hydrazides and hydrazones described in U.S. Pat. No. 3,227,552, quaternary salt compounds described in British Pat. No. 1,283,835, Japanese Patent Publication 38164/74 and U.S. Pat. Nos. 3,734,738, 3,719,494 and 3,615,615, sensitizing dyes having a substituent having a fogging function (nucleating) in the dye molecule described in U.S. Pat. No. 3,718,470, and acylhydrazinophenylthiourea compounds described in U.S. Pat. Nos. 4,030,925 and 4,031,127.

As dye image donative compounds used in the present invention, though various compounds can be utilized, couplers and dye releasing redox compounds are particulary useful.

In the dye releasing redox compounds, examples of those which release a dye alkali by hydrolysis of the compound subjected to oxidation include those described in the following documents.

U.S. Pat. Nos. 4,053,312, 4,055,428, 4,076,529, 4,152,153 and 4,135,929, Japanese Patent Application (OPI) Nos. 149328/78, 104343/76, 46730/78, 130122/79, 3819/78, 12642/81, 16130/81 and 16131/81.

Compounds which release a yellow dye: U.S. Pat. No. 4,013,633, Japanese Patent Application (OPI) Nos. 149328/78, 114930/76 and 71072/81 and *Research Disclosure,* 17630 (1978) and 16475 (1977), etc.

Compounds which release a magenta dye: U.S. Pat. Nos. 3,954,476, 3,931,144, 3,932,308, 4,250,246 and 4,255,509, Japanese Patent Application (OPI) Nos. 23628/78, 106727/77, 65034/79, 36804/80, 73057/81, 71060/81 and 134850/80 and German Patent Application (OLS) No. 2,847,371, etc.

Compounds which release a cyan dye: U.S. Pat. Nos. 3,942,987, 3,929,760 and 4,013,635, Japanese Patent Application (OPI) Nos. 109928/76, 149328/78, 8827/77, 143323/78, 47823/78 and 71061/81, etc.

Further, examples of redox compounds which release a dye by ring-closure of the compound which is not subjected to oxidation include those described in the following documents.

U.S. Pat. Nos. 4,139,379 and 3,980,479, and German Patent Application (OLS) Nos. 2,402,900 and 2,448,811, etc.

In the sensitive materials for the color diffusion transfer process, it is possible to use conventionally used dyes, couplers, latexes, surface active agents, silver halide developing agents (hydroquinones or pyrazolidinone, etc.), processing compositions (alkali agents, antioxidants or silver ion concentration controllers, etc.), etc.

Further, the dye releasing redox compounds can be dispersed in the hydrophilic colloids of the carrier by conventional various methods.

The process for obtaining color diffusion transfer images using the dye releasing redox compounds have been described in *Photographic Science and Engineering,* Vol. 20, No. 4, pp. 155–164, July/August, 1976.

In the above-described process, any silver halide developing agent can be used if it can cause cross-oxidation of the dye releasing redox compounds. Such developing agents may be contained in the alkaline processing composition or may be contained in a suitable layer of the photographic element.

Mordanting layers, neutralizing layers, layers for controlling neutralizing rate (timing layer) and processing compositions, etc., capable of being used for light-sensitive materials for the color diffusion transfer process of the present invention are described in, for example, Japanese Patent Application (OPI) No. 64533/77.

It is preferred that the light-sensitive materials for the color diffusion transfer process of the present invention have a structure of monosheet type film unit (where the light-sensitive element, the image receiving element and the processing element are combined) which is always united before, during and after exposure to light and can be developed in the light. Such film units have been described in the above-mentioned *Photographic Science and Engineering* and *Noblette's Handbook of Photography and Reprography Materials, Process and Systems,* Seventh Ed. (1977), Chapter 12, 35c.

In the following, examples used in the present invention are illustrated. However, the present invention is not limited to these examples.

EXAMPLE 1

Silver halide grains are precipitated by a double jet process. After they were subjected to physical aging and desalting treatment, they were chemically aged to obtain a silver iodobromide emulsion (iodide content: 8.5% by mol). The average diameter of silver halide grains contained in this emulsion was 0.7 micron. In 1 kg of this emulsion, 0.55 mol of silver halide were contained.

1 kg of this emulsion was put in a pot and heated to 40° C. to dissolve. A solution of the sensitizing dye in methanol was added in a desired amount with stirring. Further, 10 ml of a 1.0 wt% aqueous solution of 4-hydroxy-6-methyl-1,3,3a,7-tetraazaindene was added thereto, and 10 ml of a 1.0 wt% aqueous solution of 1-hydroxy-3,5-dichlorotriazine sodium salt was added. Further, 10 ml of a 1.0 wt% aqueous solution of sodium dodecylbenzenesulfonate was added thereto, and the mixture was stirred. The resulting emulsion was applied to a cellulose triacetate film base so as to result in a dry film thickness of 5 microns and dried to obtain a sample of light-sensitive material. This film sample was exposed to light wedge through a yellow filter (SC-50) produced by Fuji Photo Film Co. or a blue filter (Wratten 47B) produced by Eastman Kodak Co. by means of a sensitometer having a light source of a color temperature of 5,400° K.

After exposure, it was developed at 20° C. for 7 minutes with a developing solution having the following composition, and it was subjected to stopping, fixing and water wash to obtain a strip having a prescribed black-and-white image. Using a P-type densitometer produced by Fuji Photo Film Co., measurement of density was carried out to obtain sensitivity and fog. The standard of the optical density by which the sensitivity was determined was a point of (fog+0.20).

| Composition of Developing Solution: | |
|---|---|
| Water | 700 ml |
| Metol | 2.0 g |
| Anhydrous Sodium Sulfite | 100.0 g |
| Hydroquinone | 5.0 g |
| Borax (5 hydrate) | 1.5 g |
| Water to make | 1 liter |

The results obtained are shown as relative values in Table 1. These results show that the sensitizing dyes of the present invention produce light-sensitive materials having a high sensitivity and low fog.

Chemical structure of sensitizing dyes used for comparison:

Comparative Dye $A_1$

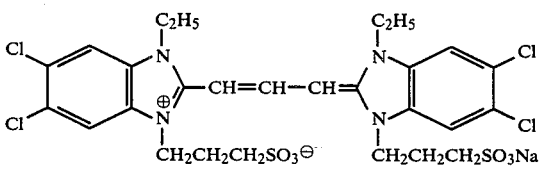

Comparative Dye $B_1$

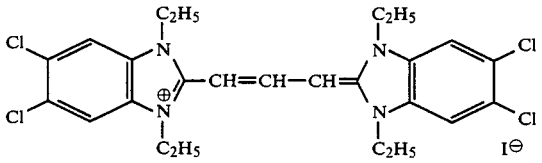

TABLE 1

| Test No. | Sensitizing Dye and Amount Used ($\times 10^{-5}$ mol/kg emulsion) | | Relative Sensitivity (yellow filter) | Relative Sensitivity (blue filter) | Fog |
|---|---|---|---|---|---|
| 1 | — | | — | 100 | 0.04 |
| 2 | (Dye I-3) | 8.4 | 93 | 81 | 0.04 |
| 3 | | 16.8 | 115 | 69 | 0.04 |
| 4 | (Dye I-22) | 4.2 | 81 | 100 | 0.04 |
| 5 | | 8.4 | 120 | 89 | 0.04 |
| 6 | | 16.8 | 170 | 89 | 0.04 |
| 7 | (Comparative Dye $A_1$) | 8.4 | 76 | 79 | 0.04 |
| 8 | | 16.8 | 98 | 72 | 0.04 |
| 9 | | 33.6 | 100 | 62 | 0.07 |
| 10 | (Comparative Dye $B_1$) | 8.4 | 21 | 79 | 0.04 |
| 11 | | 16.8 | 28 | 64 | 0.04 |
| 12 | | 33.6 | 32 | 44 | 0.07 |

Comparative Dye $A_1$ is a typical imidazocarbocyanine dye described in U.S. Pat. No. 2,912,329 and Comparative Dye $B_1$ is a typical imidazocarbocyanine dye described in U.S. Pat. No. 2,739,149. It is understood that the sensitizing dyes of the present invention are excellent as compared with the comparative dyes, because they have a high spectral sensitivity (sensitivity using a yellow filter).

EXAMPLE 2

The same light-sensitive material as prepared in Example 1 except that iodide content was 7.5% instead of 8.5% by mol and Sensitizing Dyes II-2, II-22, Comparative Dye $A_2$ and Comparative Dye $B_2$ were used in place of Sensitizing Dyes I-3, I-22, Comparative Dye $A_1$ and Comparative Dye $B_1$. This film was exposed and processed in the same manner as in Example 1 and measurement of density was carried out in the same manner as in Example 1.

The results obtained are shown as relative values in Table 2. These results show that the sensitizing dyes of the present invention produce light-sensitive materials having a high sensitivity and low fog.

Chemical structure of sensitizing dyes used for comparison:

Comparative Dye $A_2$

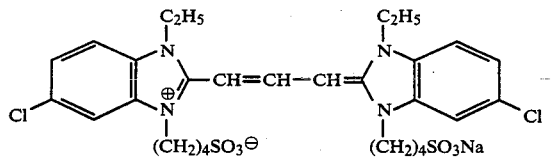

Comparative Dye $B_2$

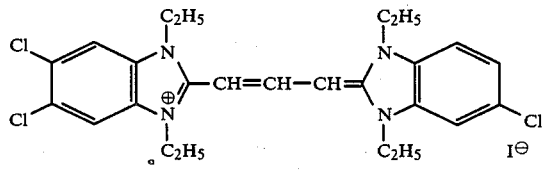

TABLE 2

| Test No. | Sensitizing Dye and Amount Used ($\times 10^{-5}$ mol/kg emulsion) | | Relative Sensitivity (yellow filter) | Relative Sensitivity (blue filter) | Fog |
|---|---|---|---|---|---|
| 1 | — | | — | 100 | 0.05 |
| 2 | (II-2) | 4.2 | 97 | 96 | 0.05 |

TABLE 2-continued

| Test No. | Sensitizing Dye and Amount Used ($\times 10^{-5}$ mol/kg emulsion) | Relative Sensitivity (yellow filter) | Relative Sensitivity (blue filter) | Fog |
|---|---|---|---|---|
| 3 | 8.4 | 148 | 76 | 0.05 |
| 4 | 16.8 | 208 | 71 | 0.05 |
| 5 | (II-22) 8.4 | 155 | 96 | 0.05 |
| 6 | 16.8 | 208 | 85 | 0.05 |
| 7 | 33.6 | 138 | 35 | 0.06 |
| 8 | (Comparative Dye $A_2$) 8.4 | 71 | 85 | 0.05 |
| 9 | 16.8 | 100 | 55 | 0.06 |
| 10 | 33.6 | 81 | 24 | 0.11 |
| 11 | (Comparative Dye $B_2$) 8.4 | 91 | 74 | 0.06 |
| 12 | 16.8 | 126 | 68 | 0.06 |
| 13 | 33.6 | 107 | 32 | 0.09 |

Comparative Dye $A_2$ is an imidazocarbocyanine dye described in U.S. Pat. No. 2,912,329 and Comparative Dye $B_2$ is an imidazocarbocyanine dye described in U.S. Pat. No. 2,739,149. It is understood that the sensitizing dyes of the present invention are excellent as compared with the comparative dyes, because they have a high spectral sensitivity (sensitivity using a yellow filter).

EXAMPLE 3

Using the same silver halide emulsion as in Example 1, samples of light-sensitive materials were obtained by adding sensitizing dyes, applying and drying by the same method as in Example 1. One of the resulting film samples was allowed to stand at a relative humidity of 75% and a temperature of 50° C. for 3 days. Another sample was allowed to stand at a relative humidity of 20% and a temperature of 50° C. for 3 days, and then they were exposed to light and developed by the same manner as in Example 1. Changes of sensitivity and fog of them were measured. Results obtained are shown as relative values in Table 3.

TABLE 3

| Test No. | Sensitizing Dyes and Amount Used ($\times 10^{-5}$ mol/kg emulsion) | 60% RH, 20° C., 3 Days[a] Relative Sensitivity | 60% RH, 20° C., 3 Days[a] Fog | 20% RH, 50° C., 3 Days Relative Sensitivity | 20% RH, 50° C., 3 Days Fog | 75% RH, 50° C., 3 Days[b] Relative Sensitivity | 75% RH, 50° C., 3 Days[b] Fog | Reduction of Sensitivity at High Temperature and High Humidity (b/a × 100) |
|---|---|---|---|---|---|---|---|---|
| 1 | (Dye I-6) 4.2 | 89 | 0.04 | 112 | 0.06 | 68 | 0.04 | 76 |
| 2 | 8.4 | 126 | 0.04 | 158 | 0.06 | 102 | 0.04 | 81 |
| 3 | 16.8 | 174 | 0.04 | 210 | 0.07 | 151 | 0.05 | 87 |
| 4 | (Dye I-7) 4.2 | 80 | 0.04 | 101 | 0.06 | 64 | 0.04 | 80 |
| 5 | 8.4 | 112 | 0.04 | 144 | 0.06 | 90 | 0.04 | 80 |
| 6 | 16.8 | 170 | 0.04 | 214 | 0.08 | 143 | 0.05 | 84 |
| 7 | (Dye I-2) 4.2 | 68 | 0.04 | 84 | 0.06 | 50 | 0.04 | 74 |
| 8 | 8.4 | 86 | 0.04 | 111 | 0.06 | 72 | 0.04 | 84 |
| 9 | 16.8 | 107 | 0.04 | 148 | 0.07 | 94 | 0.05 | 88 |
| 10 | (Comparative Dye $A_1$) 4.2 | 56 | 0.04 | 63 | 0.07 | 36 | 0.04 | 64 |
| 11 | 8.4 | 80 | 0.04 | 90 | 0.08 | 55 | 0.04 | 69 |
| 12 | 16.8 | 100 | 0.04 | 78 | 0.12 | 72 | 0.05 | 72 |
| 13 | (Comparative Dye $C_1$) 4.2 | 65 | 0.04 | 51 | 0.12 | 51 | 0.07 | 78 |
| 14 | 8.4 | 89 | 0.04 | 35 | 0.23 | 62 | 0.11 | 70 |
| 15 | 16.8 | 76 | 0.06 | * | 0.43 | 36 | 0.14 | 47 |

*Measurement is impossible to carry out because sensitivity remarkably reduced.

Chemical structure of the sensitizing dye used for comparison:

Comparative Dye $C_1$

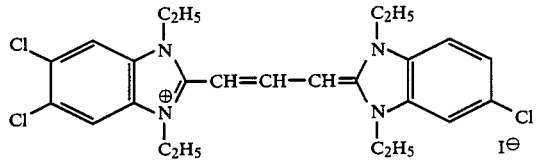

As is obvious from the results shown in Table 3, the sensitizing dyes of the present invention cause less increase of fog even under a high temperature (20% RH, 50° C.) and less reduction of sensitivity even under a high temperature and a high humidity (75% RH, 50° C.).

EXAMPLE 4

The same procedures as in Example 3 were repeated except that the silver halide emulsion as in Example 2 was used and samples of light-sensitive materials were obtained in the same manner as in Example 2.

Changes of sensitivity and fog of them were measured. Results obtained are shown as relative values in Table 4.

TABLE 2

| Test No. | Sensitizing Dyes and Amount Used ($\times 10^{-5}$ mol/kg emulsion) | 60% RH, 20° C., 3 Days[a] Relative Sensitivity | 60% RH, 20° C., 3 Days[a] Fog | 20% RH, 50° C., 3 Days Relative Sensitivity | 20% RH, 50° C., 3 Days Fog | 75% RH, 50° C., 3 Days[b] Relative Sensitivity | 75% RH, 50° C., 3 Days[b] Fog | Reduction of Sensitivity at High Temperature and High Humidity (b/a × 100) |
|---|---|---|---|---|---|---|---|---|
| 1 | (Dye II-1) 4.2 | 72 | 0.05 | 96 | 0.06 | 56 | 0.05 | 78 |
| 2 | 8.4 | 112 | 0.05 | 145 | 0.06 | 93 | 0.05 | 83 |
| 3 | 16.8 | 155 | 0.06 | 170 | 0.09 | 135 | 0.07 | 87 |
| 4 | (Dye II-7) 4.2 | 81 | 0.05 | 110 | 0.06 | 65 | 0.05 | 80 |

TABLE 2-continued

| Test No. | Sensitizing Dyes and Amount Used ($\times 10^{-5}$ mol/kg emulsion) | | 60% RH, 20° C., 3 Days[a] Relative Sensitivity | Fog | 20% RH, 50° C., 3 Days Relative Sensitivity | Fog | 75% RH, 50° C., 3 Days[b] Relative Sensitivity | Fog | Reduction of Sensitivity at High Temperature and High Humidity (b/a × 100) |
|---|---|---|---|---|---|---|---|---|---|
| 5 | | 8.4 | 115 | 0.05 | 150 | 0.06 | 94 | 0.05 | 82 |
| 6 | | 16.8 | 174 | 0.05 | 230 | 0.07 | 141 | 0.06 | 81 |
| 7 | (Dye II-25) | 4.2 | 83 | 0.05 | 105 | 0.06 | 65 | 0.05 | 78 |
| 8 | | 8.4 | 118 | 0.05 | 152 | 0.06 | 100 | 0.05 | 85 |
| 9 | | 16.8 | 158 | 0.05 | 185 | 0.07 | 129 | 0.06 | 82 |
| 10 | (Comparative Dye $C_2$) | 4.2 | 66 | 0.05 | 59 | 0.12 | 50 | 0.06 | 76 |
| 11 | | 8.4 | 80 | 0.06 | 56 | 0.12 | 55 | 0.10 | 69 |
| 12 | | 16.8 | 100 | 0.08 | 53 | 0.28 | 40 | 0.24 | 40 |
| 13 | (Comparative Dye $D_2$) | 4.2 | 74 | 0.05 | 63 | 0.08 | 52 | 0.07 | 70 |
| 14 | | 8.4 | 85 | 0.06 | 87 | 0.12 | 60 | 0.09 | 71 |
| 15 | | 16.8 | 93 | 0.09 | 33 | 0.22 | 59 | 0.16 | 63 |

Chemical Structure of sensitizing dyes used for comparison:

Comparative Dye $C_2$

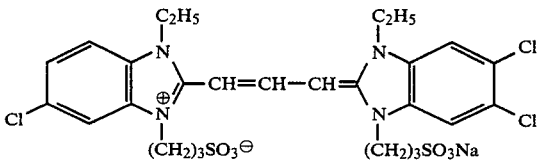

Comparative Dye $D_2$

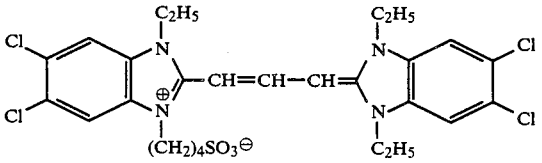

As is obvious from the results shown in Table 4, the sensitizing dyes of the present invention cause less increase of fog even under a high temperature (20% RH, 50° C.) and less reduction of sensitivity even under a high temperature and a high humidity (75% RH, 50° C.).

EXAMPLE 5

Using the same silver halide emulsion as in Example 1, samples of light-sensitive materials were obtained by adding sensitizing dyes, applying and drying by the same manner as in Example 1. One of the samples was allowed to stand under a relative humidity of 60% and a temperature of 20° C. for 3 months after application. Thereafter, it was exposed to light and developed by the same manner as in Example 1, and changes of sensitivity and fog were measured. Results obtained are shown as relative values in Table 5.

TABLE 5

| Test No. | Sensitizing Dye and Amount Used ($\times 10^{-5}$ mol/kg emulsion) | | Just after[a] Application Relative Sensitivity | Fog | Passage of 3 Months[b] Relative Sensitivity | Fog | Reduction of Sensitivity with Passage of Time (b/a × 100) |
|---|---|---|---|---|---|---|---|
| 1 | (Dye I-1) | 4.2 | 78 | 0.04 | 73 | 0.04 | 94 |
| 2 | | 8.4 | 100 | 0.04 | 93 | 0.04 | 93 |
| 3 | | 16.8 | 123 | 0.04 | 118 | 0.04 | 96 |
| 4 | (Dye I-5) | 4.2 | 80 | 0.04 | 77 | 0.04 | 96 |
| 5 | | 8.4 | 115 | 0.04 | 112 | 0.04 | 97 |
| 6 | | 16.8 | 155 | 0.04 | 145 | 0.04 | 94 |
| 7 | (Dye I-22) | 4.2 | 89 | 0.04 | 89 | 0.04 | 100 |
| 8 | | 8.4 | 132 | 0.04 | 132 | 0.04 | 100 |
| 9 | | 16.8 | 186 | 0.04 | 174 | 0.04 | 94 |
| 10 | (Comparative Dye $D_1$) | 4.2 | 80 | 0.04 | 64 | 0.04 | 80 |
| 11 | | 8.4 | 117 | 0.04 | 89 | 0.06 | 76 |
| 12 | | 16.8 | 158 | 0.04 | 112 | 0.07 | 71 |
| 13 | (Comparative Dye $E_1$) | 4.2 | 78 | 0.04 | 62 | 0.05 | 79 |
| 14 | | 8.4 | 91 | 0.05 | 69 | 0.06 | 79 |
| 15 | | 16.8 | 100 | 0.08 | 69 | 0.11 | 69 |

Chemical structure of the sensitizing dyes used for comparison:

Comparative Dye $D_1$

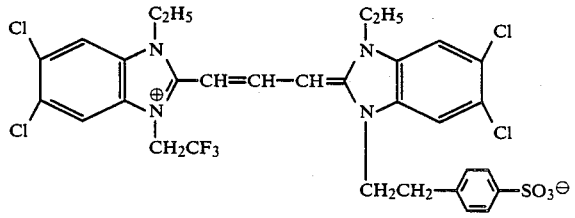

-continued

Comparative Dye $E_1$

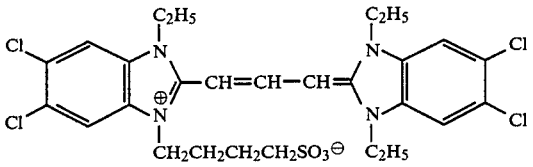

As is obvious from Table 5, sensitizing dyes used for comparison cause not only increase of fog but also reduction of sensitivity with passage of time, as compared with sensitizing dyes of the present invention. On the other hand, the sensitizing dyes of the present invention cause less reduction of sensitivity with passage of time and no increase of fog. This fact means that light-sensitive materials excellent in stability with passage of time can be provided using sensitizing dyes of the present invention.

EXAMPLE 6

The same procedures as in Example 5 were repeated except that the silver halide emulsion as in Example 2 was used and samples of light-sensitive materials were obtained in the same manner as in Example 2.

Results obtained are shown as relative values in Table 6.

TABLE 6

| Test No. | Sensitizing Dye and Amount Used ($\times 10^{-5}$ mol/kg emulsion) | | Just after[a] Application Relative Sensitivity | Just after[a] Application Fog | Passage of 3 Months[b] Relative Sensitivity | Passage of 3 Months[b] Fog | Reduction of Sensitivity with Passage of Time (b/a × 100) |
|---|---|---|---|---|---|---|---|
| 1 | (Dye II-3) | 4.2 | 85 | 0.05 | 79 | 0.05 | 93 |
| 2 | | 8.4 | 115 | 0.05 | 108 | 0.05 | 94 |
| 3 | | 16.8 | 159 | 0.05 | 152 | 0.05 | 96 |
| 4 | (Dye II-13) | 4.2 | 89 | 0.05 | 85 | 0.05 | 96 |
| 5 | | 8.4 | 126 | 0.05 | 118 | 0.05 | 94 |
| 6 | | 16.8 | 176 | 0.05 | 164 | 0.05 | 93 |
| 7 | (Dye II-23) | 4.2 | 78 | 0.05 | 77 | 0.05 | 99 |
| 8 | | 8.4 | 120 | 0.05 | 118 | 0.05 | 98 |
| 9 | | 16.8 | 178 | 0.05 | 178 | 0.05 | 100 |
| 10 | (Comparative Dye $E_2$) | 4.2 | 48 | 0.05 | 37 | 0.06 | 77 |
| 11 | | 8.4 | 66 | 0.05 | 49 | 0.07 | 74 |
| 12 | | 16.8 | 100 | 0.05 | 71 | 0.09 | 71 |
| 13 | (Comparative Dye F) | 4.2 | 77 | 0.05 | 59 | 0.06 | 77 |
| 14 | | 8.4 | 102 | 0.06 | 73 | 0.08 | 72 |
| 15 | | 16.8 | 115 | 0.08 | 66 | 0.12 | 57 |

Chemical structure of the sensitizing dyes used for comparison:

Comparative Dye $E_2$

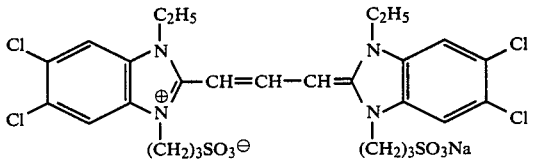

-continued

Comparative Dye F

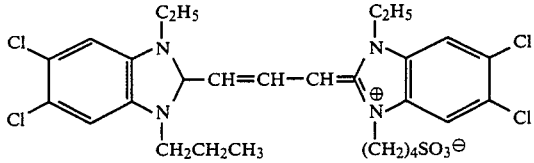

The Comparative Dye $E_2$ is an imidazocarbocyanine dye described in U.S. Pat. No. 2,912,329, and the Comparative Dye F is an imidazocarbocyanine dye having a chemical structure analogous to Dye II-3 of the present invention (the substituent in 3-position is $-CH_2CF_2CF_3$ which is different from $-CH_2CH_2CH_3$). These comparative dyes cause not only increase of fog but also reduction of sensitivity with passage of time. On the other hand, the sensitizing dyes of the present invention cause less reduction of sensitivity with passage of time and no increase of fog. This fact means that light-sensitive materials excellent in stability with passage of time can be provided using sensitizing dyes of the present invention.

EXAMPLE 7

A chemically sensitized silver iodobromide emulsion containing 8% by mol of silver iodide (average particle size: 1.1 microns, gelatin 70 g/kg emulsion, silver amount of 0.7 mol/kg emulsion) was obtained. 1 kg of this emulsion was heated to 40° C., and 500 g of an emulsion of Color Coupler D represented by the following formula was added thereto. The emulsion of Color Coupler D was that which was prepared by dissolving 100 g of Color Coupler D by adding 200 ml of ethyl acetate and tricresyl phosphate, adding sodium dodecylbenzenesulfonate as an emulsifying assistant, and emulsifying the solution in 1,000 g of a 10% aqueous solution.

To the emulsion, a prescribed amount of a solution of a sensitizing dye in methanol was added, and the mixture was stirred. Furthermore, 20 ml of a 1.0 wt% aqueous solution of 4-hydroxy-6-methyl-1,3,3a,7-tetraazaindene, 50 ml of a 2.0 wt% aqueous solution of 1-hydroxy-3,5-dichlorotriazine sodium salt and 10 ml of a 2.0 wt% aqueous solution of sodium dodecylbenzenesulfonate were added thereto. The finished emulsion was applied to a cellulose triacetate film base so as to result in a silver amount of 5 g/m$^2$, and dried to obtain a sample. This film sample was exposed to light wedge through a green filter (BPB-53) produced by Fuji Photo Film Co. by means of a sensitometer having a light source of a color temperature of 5,400° K.

After being exposed to light, it was developed according to the following prescription. After bleached and fixed, it was dried, and density of the magenta images developed was measured. The standard of the optical density by which the sensitivity was determined was a point of (Fog +0.20).

Prescription for Development Processing:

| Stage | Time |
|---|---|
| 1. Color Development | 3 minutes and 15 seconds (38° C.) |
| 2. Bleach | 6 minutes and 30 seconds |
| 3. Water Wash | 3 minutes and 15 seconds |
| 4. Fixation | 6 minutes and 30 seconds |
| 5. Water Wash | 3 minutes and 15 seconds |
| 6. Stabilization | 3 minutes and 15 seconds |

Compositions of processing solutions used in each stage were as follows.

| | |
|---|---|
| Color Developing Solution: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamine)-2-methylaniline Sulfate | 4.5 g |
| Water to make | 1 liter |
| Bleaching Solution: | |
| Ammonium Bromide | 160.0 g |
| Aqueous Ammonia (28%) | 25.0 ml |
| Ethylenediaminetetraacetato Sodium Iron Complex Salt | 130.0 g |
| Glacial Acetic Acid | 14.0 ml |
| Water to make | 1 liter |
| Fixing Solution: | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |
| Stabilizing Solution: | |
| Formalin | 8 ml |
| Water to make | 1 liter |

Coupler D

-continued

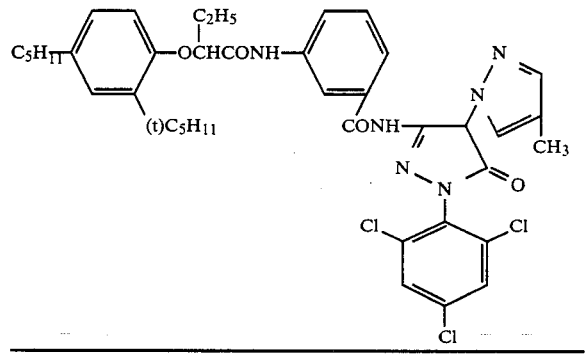

TABLE 7

| Test No. | Sensitizing Dye and Amount Used (× 10$^{-5}$ mol/kg emulsion) | | Just after[a] Application Relative Sensitivity | Just after[a] Application Fog | 60% RH, 20° C., 3 Months[b] Relative Sensitivity | 60% RH, 20° C., 3 Months[b] Fog | Reduction of Sensitivity with Passage of Time (b/a × 100) |
|---|---|---|---|---|---|---|---|
| 1 | (Dye I-7) | 5 | 84 | 0.20 | 82 | 0.20 | 98 |
| 2 | | 10 | 117 | 0.23 | 117 | 0.23 | 100 |
| 3 | | 20 | 182 | 0.26 | 170 | 0.26 | 93 |
| 4 | (Dye I-8) | 5 | 79 | 0.20 | 73 | 0.20 | 92 |
| 5 | | 10 | 102 | 0.25 | 93 | 0.25 | 91 |
| 6 | | 20 | 123 | 0.30 | 112 | 0.30 | 91 |
| 7 | (Comparative Dye $A_1$) | 5 | 87 | 0.23 | 70 | 0.23 | 80 |
| 8 | | 10 | 100 | 0.26 | 74 | 0.28 | 74 |
| 9 | | 20 | 100 | 0.37 | 71 | 0.45 | 71 |

As is obvious from the results shown in Table 7, reduction of sensitivity with the passage of time can be remarkably prevented when Sensitizing Dyes I-7 and I-8 of the present invention are used.

EXAMPLE 8

A silver iodobromide emulsion chemically sensitized with gold and sulfur (average particle size: 1.0μ, iodine content: 6.0% by mol, silver content: 80 g/kg emulsion, amount of gelatin: 60 g/kg emulsion) was spectrally sensitized by adding a prescribed amount of a solution of a sensitizing dye.

This emulsion was applied together with an emulsion of the magenta coupler: 1-(2,4,6-trichlorophenyl)-3-[3-(2,4-di-t-aminophenoxyacetamido)benzamido]-5-pyrazolone to a cellulose triacetate film (amount of silver coated: 1.1 g/m$^2$), and dried.

After the resulting sample was allowed to stand at a relative humidity and a temperature shown in Table 8 for 3 days, it was exposed to light through a blue filter and a neutral gray wedge for sensitometry by means of a sensitometer having a light source of a color temperature of 4,800° K. A change of the maximum density obtained by development processing was measured.

Processing stages and processing solutions used are as follows.

| Stage | Time (minute) | Temperature |
|---|---|---|
| Processing Stage | | |
| The 1st Development | 6 | 38° C. |
| Water Wash | 2 | " |
| Reversal | 2 | " |
| Color Development | 6 | " |
| Adjustment | 2 | " |
| Bleaching | 6 | " |
| Fixation | 4 | " |

-continued

| | | |
|---|---|---|
| Water Wash | 4 | " |
| Stabilization | 1 | Normal Temperature |

| | |
|---|---|
| Drying | |
| The 1st Development Bath | |
| Water | 700 ml |
| Sodium Tetrapolyphosphate | 2 g |
| Sodium Sulfite | 20 g |
| Hydroquinone Monosulfonate | 30 g |
| Sodium Carbonate (1 hydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% soln.) | 2 ml |
| Water to make | 1,000 ml |
| Reversal Bath | |
| Water | 700 ml |
| Nitrilo-N,N,N—trimethylenephosphonic Acid 6 Na Salt | 3 g |
| Stannous Chloride (2 hydrate) | 1 g |
| p-Aminophenol | 0.1 g |
| Sodium Hydroxide | 8 g |
| Glacial Acetic Acid | 15 ml |
| Water to make | 1,000 ml |
| Color Development Bath | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% soln.) | 90 ml |
| Sodium Hydroxide | 3 g |
| Citrazinic Acid | 1.5 g |
| N—Ethyl-N—(β-sulfonamidoethyl)-3-methylaminoaniline Sulfate | 11 g |
| Ethylenediamine | 3 g |
| Water to make | 1,000 ml |
| Adjustment Bath | |
| Water | 700 ml |
| Sodium Sulfite | 12 g |
| Sodium Ethylenediaminetetraacetate (2 hydrate) | 8 g |
| Thioglycerine | 0.4 ml |
| Glacial Acetic Acid | 3 ml |
| Water to make | 1,000 ml |
| Bleaching Bath | |
| Water | 800 ml |
| Sodium Ethylenediaminetetraacetate (2 hydrate) | 2.0 g |
| Ethylenediaminetetraacetato Iron (II) Ammonium (2 hydrate) | 120.0 g |
| Potassium Bromide | 100.0 g |
| Water to make | 1.0 l |
| Fixing Bath | |
| Water | 800 ml |
| Ammonium Thiosulfate | 80.0 ml |
| Sodium Sulfite | 5.0 g |
| Sodium Bisulfite | 5.0 g |
| Water to make | 1.0 l |
| Stabilizing Bath | |
| Water | 800 ml |
| Formalin (37% by weight) | 5.0 ml |
| Fuji Driwel | 5.0 ml |
| Water to make | 1.0 l |

Results obtained are shown in Table 8.

TABLE 8

| Test No. | Sensitizing Dye and Amount Used ($\times 10^{-5}$ mol/kg emulsion) | | Reduction of Maximum Density from Fresh State: 55° C., 30% 3 Days (%) | Reduction of Maximum Density from Fresh State: 60° C., 60% 3 Days (%) |
|---|---|---|---|---|
| 1 | (Dye II-1) | 30.1 | 37.5 | 65.3 |
| 2 | (Dye II-3) | 30.1 | 25.3 | 61.2 |
| 3 | (Dye II-7) | 30.1 | 18.9 | 49.8 |
| 4 | (Dye II-23) | 30.1 | 21.1 | 54.7 |
| 5 Comparison | (Dye $D_2$) | 30.1 | 43.8 | 73.1 |

It is understood from the results shown in Table 8 that the Sensitizing Dyes II-1 to II-4 of the present invention cause less reduction of maximum density even under a high temperature (55° C., 30%, 3 days) and under a high temperature and a high humidity (60° C., 60%, 3 days).

EXAMPLE 9

After the same sample as that used in Example 8 was exposed to light by the same manner as in Example 8, it was allowed to stand at a humidity and a temperature shown in Table 9 for 3 days. This sample was subjected to the same development processing as in Example 8. A change of sensitivity in the highlight part (density 0.2) is shown in Table 9.

TABLE 9

| Test No. | Sensitizing Dye and Amount Used ($\times 10^{-5}$ mol/kg emulsion) | | Reduction of Sensitivity from Fresh State ΔS 0.2: 50° C., 30% 3 Days | Reduction of Sensitivity from Fresh State ΔS 0.2: 45° C., 80% 3 Days |
|---|---|---|---|---|
| 1 | (Dye II-1) | 30.1 | 0.26 | 0.31 |
| 2 | (Dye II-3) | 30.1 | 0.20 | 0.26 |
| 3 | (Dye II-7) | 30.1 | 0.14 | 0.19 |
| 4 | (Dye II-23) | 30.1 | 0.16 | 0.21 |
| 5 Comparison | (Dye $D_2$) | 30.1 | 0.35 | 0.46 |

It is understood from the results shown in Table 9 that the Sensitizing Dyes II-1 to II-4 of the present invention cause less reduction of sensitivity in the highlight part even under a high temperature (50° C., 30%, 3 days) and under a high temperature and a high humidity (45° C., 80%, 3 days).

EXAMPLE 10

To a polyethylene terephthalate transparent base, the following layers were applied in turns to produce Light-Sensitive Elements 1 to 5.

(1) A mordanting layer containing a copolymer having the following repeating unit in the following ratio, which is described in U.S. Pat. No. 3,898,088 (3.0 g/m²):

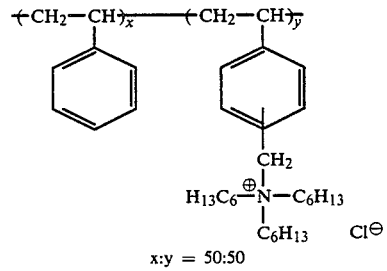

x:y = 50:50 and gelatin (3.0 g/m²).

(2) A white reflection layer containing 20 g/m² of titanium oxide and 2.0 g/m² of gelatin.

(3) A light-shielding layer containing 2.7 g/m² of carbon black and 2.7 g/m² of gelatin.

(4) A layer containing the following cyan DRR compound (0.5 g/m²), diethyllaurylamide (0.25 g/m²) and gelatin (1.14 g/m²).

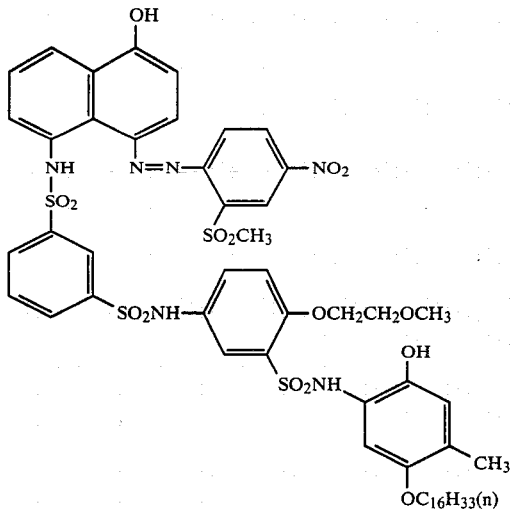

(5) A red-sensitive internal latent image type direct positive silver bromide emulsion layer containing an internal latent image type emulsion (silver content: 1.9 g/m²), a red-sensitive sensitizing dye, the following fogging agent (0.07 mg/m²), and sodium 5-pentadecylhydroquinone-2-sulfonate (0.13 g/m²).

(6) A layer containing gelatin (2.6 g/m²) and 2,5-dioctyl hydroquinone (1.0 g/m²).

(7) A layer containing the following magenta DRR compound (0.45 g/m²), diethyllaurylamide (0.10 g/m²), 2,5-di-t-butylhydroquinone (0.0074 g/m²) and gelatin (0.76 g/m²).

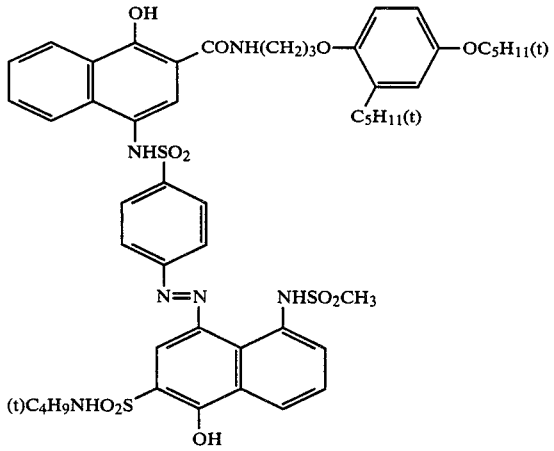

(8) To an internal latent image type emulsion (silver content: 1.4 g/m²), a green-sensitive sensitizing dye (Comparative Dye G) was added in case of the Light-Sensitive Element 1. In case of the Light-Sensitive Element 2, a green-sensitizing dye (Dye I-23) was added to the same emulsion. In case of the Light-Sensitive Element 3, a green-sensitive sensitizing dye (Dye I-24) was added to the same emulsion. In the case of the Light-Sensitive Element 4, a green-sensitive sensitizing dye (Dye II-23) was added to the same emulsion. In the case of the Light-Sensitive Element 5, a green-sensitive sensitizing dye (Dye II-24) was added to the same emulsion.

Comparative Dye G

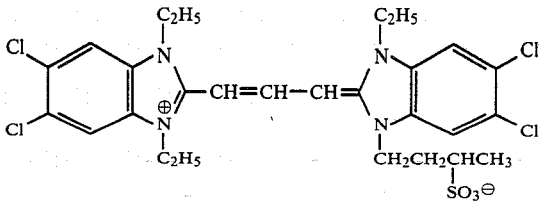

Comparative Dye G is a typical imidazocarbocyanine dye described in British Pat. Nos. 654,690 and 815,172.

A green-sensitive internal latent image type direct positive silver bromide emulsion layer containing 0.05 mg/m² of the following fogging agent and sodium 5-pentadecyl-hydroquinone-2-sulfonate (0.11 g/m²) in addition to the green-sensitive sensitizing dye.

(9) The same layer as the above (6).

(10) A layer containing the following yellow DRR compound (0.78 g/m²), diethyllaurylamide (0.16 g/m²), 2,5-di-t-butylhydroquinone (0.012 g/m²) and gelatin (0.78 g/m²).

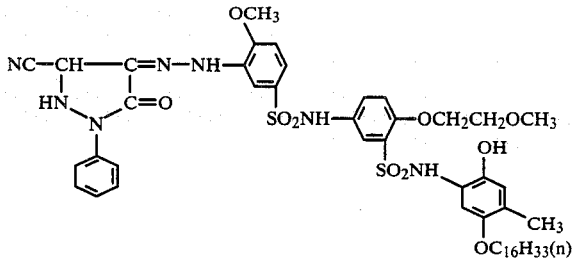

(11) A blue-sensitive internal latent image type direct positive silver bromide emulsion layer containing an internal latent image type emulsion (silver content: 2.2 g/m²), a blue-sensitive sensitizing dye, the following fogging agent (0.08 mg/m²) and sodium 5-pentadecylhydroquinone-2-sulfonate (0.094 g/m²).

(12) A layer containing gelatin (0.94 g/m²).

Fogging Agent:

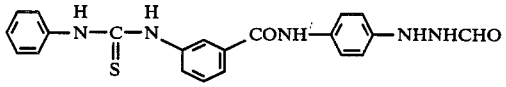

The above described Light-Sensitive Elements 1 to 5 were processed with combining the following elements.

| Processing Solution: | |
|---|---|
| 1-Phenyl-4-methyl-4-hydroxymethyl-3-pyrazolidinone | 10 g |
| Methyl Hydroquinone | 0.18 g |
| 5-Methylbenzotriazole | 4.0 g |
| Sodium Sulfite (anhydrous) | 1.0 g |
| Carboxymethyl Cellulose Na Salt | 40.0 g |
| Carbon Black | 150 g |

-continued

| Processing Solution: | |
|---|---|
| Potassium Hydroxide (28% aq. soln.) | 200 cc |
| $H_2O$ | 550 cc |

Pressure-destructible containers were filled with every 0.8 g of the processing solution having the above-described composition.

Cover Sheet

To a polyethylene terephthalate base, 15 g/m$^2$ of polyacrylic acid (10 wt% aqueous solution having a viscosity of about 1,000 cps) was applied to form an acid polymer layer, and 3.8 g/m$^2$ of acetyl cellulose (in which 39.4 g of acetyl group was formed by hydrolysis of 100 g acetyl cellulose) and 0.2 g/m$^2$ of a styrene-maleic acid anhydride copolymer (molar ratio: styrene:-maleic acid anhydride=about 60:40, molecular weight=about 50,000) were applied to the resulting layer to form a neutralizing timing layer, by which a cover sheet was produced. The Light-Sensitive Elements 1 to 5 were allowed to stand at 40° C. for 3 months after application. After they were exposed to light wedge by means of a sensitometer having a light source of a color temperature of 5,400° K., they were subjected to the following processing.

Processing Stage

The above-described cover sheet was put on the above-described light-sensitive sheet. After the light-sensitive sheet was exposed to a color test chart through the cover sheet, the above-described processing solution was spread between both sheets so as to have a thickness of 75μ (the spreading was carried out by means of a press roll). The processing was carried out at 25° C. After having carried out the processing, green density of images formed on the image receiving layer was measured through the transparent base of the light-sensitive sheet by means of a Macbeth reflection densitometer after passage of 1 hour from the processing. Results obtained are shown in Table 10.

TABLE 10

| Light-Sensitive Element | Sensitizing Dye and Amount Used (× mg/m$^2$) | | Just after[a] Application Relative Sensitivity | After Passage of[b] 3 Months at 40° C. Relative Sensitivity | Reduction with Passage of Time (b/a × 100) |
|---|---|---|---|---|---|
| 1 (Comparison) | (Comparative Dye G) | 0.71 | 100 | 63 | 63 |
| 2 | (Dye I-23) | 0.71 | 110 | 100 | 91 |
| 3 | (Dye I-24) | 0.71 | 108 | 94 | 87 |
| 4 | (Dye II-23) | 0.71 | 102 | 84 | 82 |
| 5 | (Dye II-24) | 0.71 | 106 | 80 | 75 |

*The standard of the optical density by which the sensitivity was measured was a point of (minimum density + 0.5).

It is understood from the above table that reduction of sensitivity with passage of time is very small in case of sensitizing dyes of the present invention as compared with the comparative dye.

EXAMPLE 11

When reduction of sensitivity with passage of time was measured for a comparative sample (containing Comparative Dye-G) and samples containing the following dyes by the same method as in Example 10, it was understood that the reduction was very small in case of using dyes of the present invention similarly to Example 10.

Dye I-2, Dye-I-13, Dye I-3, Dye I-21 Dye I-5, Dye I-22 and Dye I-6.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion which contains at least one of benzimidazolocarbocyanine dyes represented by the general formula (I) or (II):

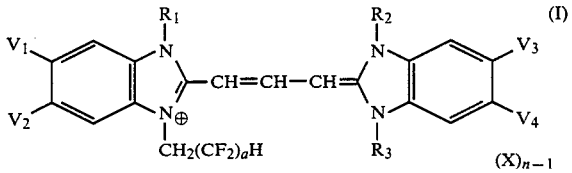

(I)

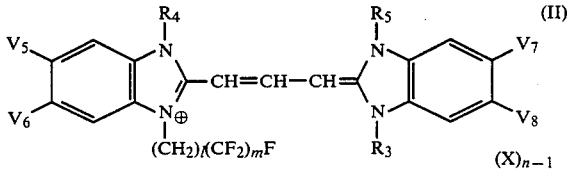

(II)

wherein a represents an integer of 1 to 8, $R_1$, $R_2$ and $R_3$, which may be identical with or different from one another, represent each $—CH_2(CF_2)_bH$ or a substituted or unsubstituted alkyl group, but at least one of $R_1$, $R_2$ and $R_3$ contains an acid group containing an alkyl group, wherein b, which may be identical with or different from a, represents an integer of 1 to 8, l represents 0 or an integer of 1 to 8, and m represents 0 or an integer of 1 to 8, but $l+m>0$; $R_4$ represents $—(CH_2)_j(CF_2)_kF$ or a substituted or unsubstituted alkyl group, $R_5$ and $R_6$, which may be the same or different, each represents an unsubstituted alkyl group or substituted alkyl group substituted with carboxy, sulfo, cyano, halogen, hydroxy, alkoxycarbonyl, alkoxy, monocyclic aryloxy, acyloxy, acyl, carbamoyl or sulfomoyl, but at least one of $R_4$, $R_5$ and $R_6$ represents an acid group-containing alkyl group; j represents 0 or an integer of 1 to 8; and k represents 0 or an integer of 1 to 8, but $j+k>0$; $V_1$, $V_2$, $V_3$, $V_4$, $V_5$, $V_6$, $V_7$, and $V_8$, which may be identical with or different from one another, represent each a hydrogen atom, a halogen atom, a substituted alkyl group, an unsubstituted alkyl group, an alkoxy group, an acyl group, an acyloxy group, an alkoxycarbonyl group, a carbamoyl group, a sulfomoyl group, a cyano group or a trifluoromethyl group; X represents an anion; and n represents 1 or 2 but represents 1 when the dye forms an inner salt.

2. A silver halide photographic emulsion as claimed in claim 1, wherein the silver halide photographic emulsion used is a silver iodobromide emulsion.

3. A silver halide photographic emulsion as claimed in claim 1, wherein the silver halide photographic emulsion used is a silver bromide emulsion.

4. A color photographic light-sensitive material, wherein color couplers are contained in silver halide photographic emulsions as claimed in claim 1.

5. A photographic light-sensitive material, wherein the color coupler is a magenta coupler as claimed in claim 4.

6. A silver halide photographic emulsion as claimed in claim 1, wherein $V_2$ and $V_4$ represent each a trifluoromethyl group, a chlorine atom or a cyano group, and $V_1$ and $V_3$ represent each a chlorine atom.

7. A silver halide photographic emulsion as claimed in claim 6, wherein one of $V_2$ and $V_4$ represents a trifluoromethyl group or a cyano group, and the other represents a chlorine atom.

8. A silver halide color photographic light-sensitive material comprising at least three layers consisting of a blue-sensitive emulsion layer, a green-sensitive emulsion layer and a red-sensitive emulsion layer, wherein the green-sensitive emulsion layer is a layer as claimed in claim 2.

9. A silver halide photographic light-sensitive material as claimed in claim 8, wherein the green-sensitive emulsion layer is a layer as claimed in claim 3.

10. A silver halide photographic light-sensitive material as claimed in claim 9, wherein the green-sensitive emulsion layer is composed of an internal latent image type silver halide photographic light-sensitive material.

* * * * *